United States Patent [19]

Cantelli

[11] 4,258,408

[45] Mar. 24, 1981

[54] DEVICE FOR NEUTRALIZING ELECTROSTATIC CHARGES

[75] Inventor: Paolo Cantelli, Bologna, Italy

[73] Assignee: Fiap S.r.l., Bologna, Italy

[21] Appl. No.: 39,594

[22] Filed: May 16, 1979

[30] Foreign Application Priority Data

May 22, 1978 [IT] Italy ..... 53341/78[U]

[51] Int. Cl.[3] ..... H05F 3/06

[52] U.S. Cl. ..... 361/213; 219/360

[58] Field of Search ..... 34/96, 97, 99, 100; 361/212, 213; 219/360, 369–371

[56] References Cited

FOREIGN PATENT DOCUMENTS

| | | | |
|---|---|---|---|
| 1350890 | 12/1963 | France | 34/99 |
| 392873 | 5/1933 | United Kingdom . | |
| 476436 | 12/1937 | United Kingdom . | |
| 910948 | 11/1962 | United Kingdom . | |
| 1106187 | 3/1968 | United Kingdom . | |
| 1192941 | 5/1970 | United Kingdom . | |
| 1266227 | 3/1972 | United Kingdom . | |
| 1336212 | 11/1973 | United Kingdom . | |
| 1356211 | 6/1974 | United Kingdom . | |
| 1500492 | 2/1978 | United Kingdom . | |
| 1540342 | 2/1979 | United Kingdom . | |

*Primary Examiner*—Harry E. Moose, Jr.

*Attorney, Agent, or Firm*—Browdy and Neimark

[57] ABSTRACT

Disclosed herein is a device that is able to produce a flow of ionized air of alternatively positive and negative sign so that it be possible to eliminate static electricity from the objects towards which the said flow is directed, in an efficient and continuous fashion; the disclosure refers in particular to a hand gripped or to a hood type hair drying apparatus.

The main characteristic lies in the fact that it comprises, in combination: a ducted electric fan connected to an electric circuit; at least one electric generator for alternatively producing electric charges of opposite sign; at least one metal electrode connected electrically to the electric generator, supported inside the said duct and placed along the path followed by the flow of air leaving the device, generated by the operation of the said electric fan; and means for actuating the electric generator during the operation of the electric fan.

5 Claims, 4 Drawing Figures

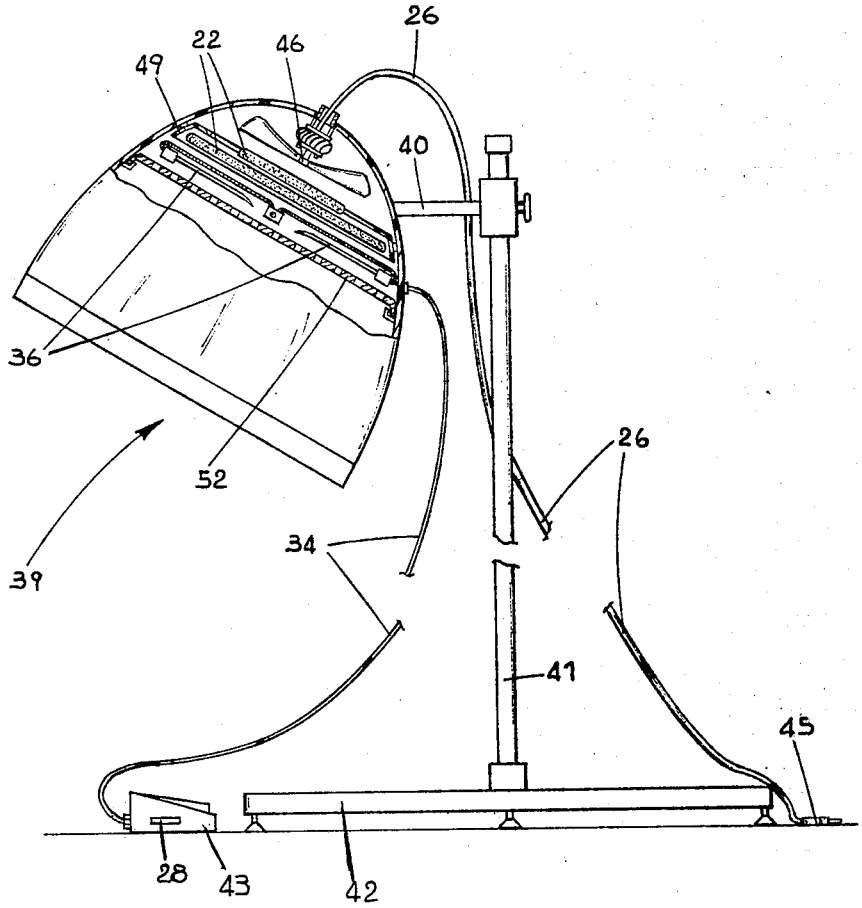
FIG 2
FIG 3
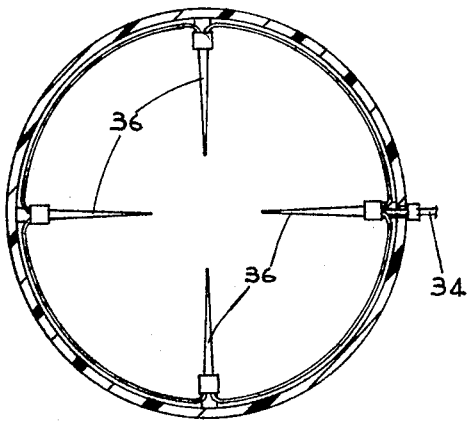
FIG 4
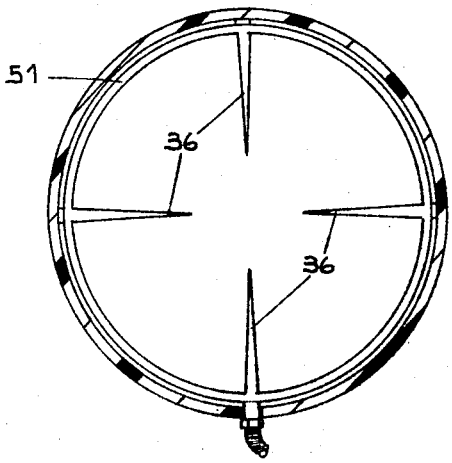

DEVICE FOR NEUTRALIZING ELECTROSTATIC CHARGES

BACKGROUND OF THE INVENTION

This invention relates to a device for neutralizing electrostatic charges.

SUMMARY OF THE INVENTION

The object of the present invention is to make available a device that is able to produce a flow of ionized air whereby it be possible to eliminate static electricity from the objects towards which the said flow is directed, in an efficient and continuous fashion.

In order that the aforementioned object can be achieved, the said device has as its subject a device for neutralizing electrostatic charges, and its main characteristic consists in the fact that it comprises, in combination:

a ducted electric fan connected to an electric supply circuit;

at least one electric generator for alternatively producing electric charges of opposite sign;

at least one metal electrode connected electrically to the electric generator and placed along the path followed by the flow of air existing from the device, generated by the operation of the said electric fan.

As will become apparent from the description that follows, the device constituting the subject of the present invention can be utilized for neutralizing electrostatic charges from gramophone records, from film made of snythetic material and from synthetic fabrics, during the manufacturing stages, as well as for a particularly advantageous application, as a hair drier.

In one preferred form of embodiment for the invention, the electric generator is constituted by a piezoelectric type transducer and it is connected to a control device that can be operated either manually or by means of a pedal.

BRIEF DESCRIPTION OF THE DRAWINGS

The characteristics of the present invention will now emerge more clearly from the following description of two preferred but not sole forms of embodiment, with reference to the accompanying drawings, in which:

FIG. 2 shows, diagrammatically and seen from the side, another type of hair drier of hood conformation made according to the invention, certain parts of which are in sectional form in order that others may be seen better;

FIG. 3 shows, diagrammatically in plan view form, one possible arrangement for the electrodes inside the hair drier depicted in FIG. 2;

FIG. 4 shows, also diagrammatically in plan view form, another arrangement possibility for the electrodes inside the hair drier depicted in FIG. 2.

DESCRIPTION OF THE PREFERRED EMBODIMENTS

Figure 1:
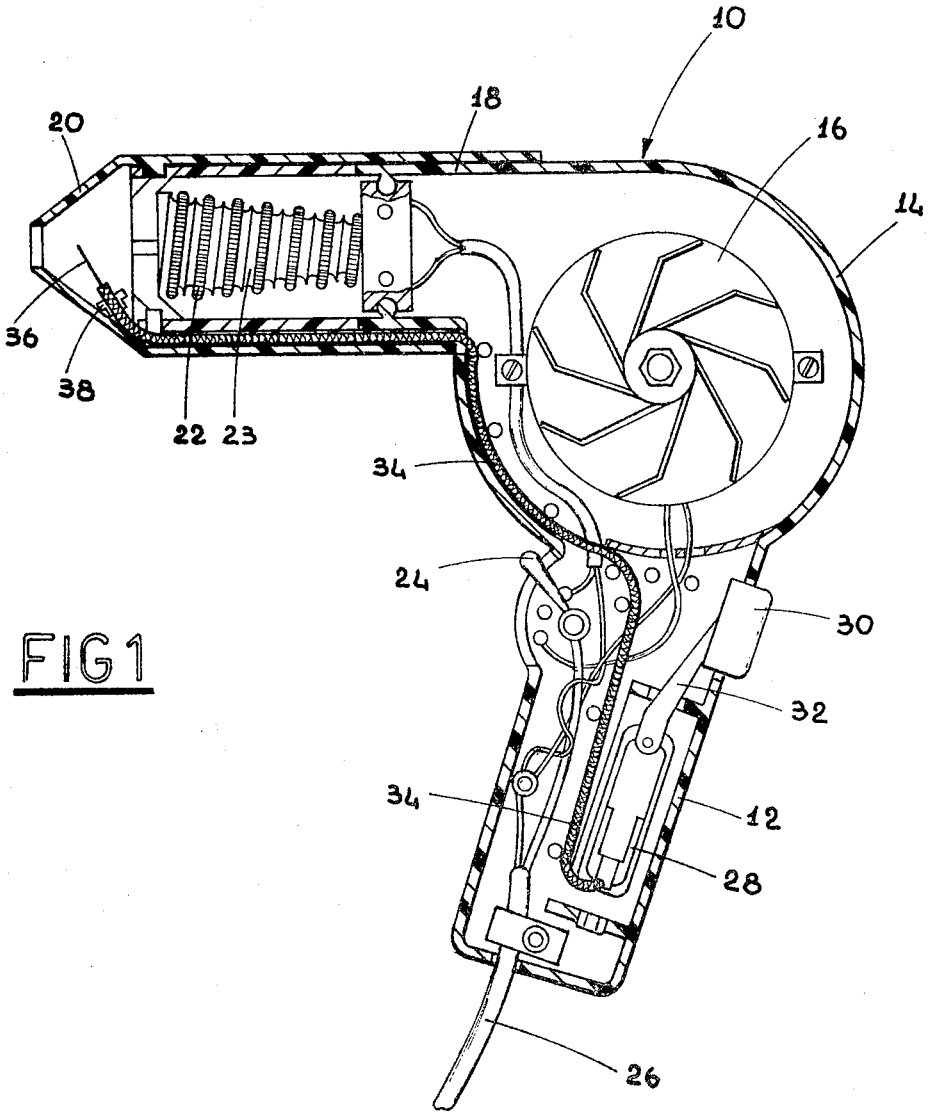
FIG. 1 shows, diagrammatically and in partial longitudinal sectional form, a fan type hair drier made according to the invention.

With reference to the above mentioned drawings and, in particular, to FIG. 1, at (10) a hair drier is shown, provided with a handgrip (12), supporting a housing (14) in which an electric fan (16) of a known type is inserted. The said housing (14) communicates with an air delivery duct (18) placed downstream with respect to the electric fan (16) and provided with an outlet mouth (20) for the said air.

The said duct (18) contains an electric heating element (22) which can be wound onto a support body (23) made of refractory insulating material.

The heating element (22) and the electric fan (16) are connected electrically through a switch (24) that is operated manually and, in the case illustrated, protrudes from handgrip (12).

A lead (26) extends externally from the handgrip (12) for the device to be connected to the mains.

In the case illustrated in FIG. 1, an electric generator (28) is housed in the inside of the handgrip (12).

Again in the example illustrated, the generator (28) is constituted by a piezoelectric type transducer operated manually through a pushbutton (30) that projects externally out of the handgrip (12) and is connected to the generator (28) by means of a metal actuating lever (32).

The operating pushbutton (30) is made in such a way that at the time it is actuated manually, the body of the said generator (28) is grounded through the body of the person by whom the hair drier device is being used.

The said characteristic makes it possible to overcome the danger of the operator being subjected to discharges while the generator (28) is in operation, which is, instead, possible without the aforementioned artifice.

The said ground connection can be made with the utilization of electrically conductive material, for example metallized plastic material, in the manufacture of the operating pushbutton (30).

Alternatively, the operating pushbutton (30) could be made of insulating material and its actuation area could be connected to the metal lever (32) via an electrically conductive member, for example a copper strip or a metal connecting screw.

Another alternative would be for the said operating pushbutton (30) to be made of material that insulates perfectly, the body of the generator (28) being connected electrically to a non-illustrated grounding cable, with use being made of the current tap at which the lead (26) terminates.

At (34) there is an electrically conductive cable connected to the generator (28) housed inside the apparatus (10) and this terminates at a metal electrode (36).

The said electrode (36) can have one or more needle type tips and it is housed inside the delivery duct (18), downstream with respect to the heating element (22), fastened to a support (38) in such a way that the tip or tips thereof point towards the air outlet mouth (20).

The generator (28) could be constituted, instead of by a piezoelectric type transducer as stated above, by an equivalent electronic device that is able to alternatively produce electric charges of opposite sign, so as to polarize the said electrode (36).

The operation of the hair drier (10) envisages, once the lead (26) has been connected to the mains, the excitation, in a way in itself known, of the electric fan (16) and of the heating element (22), which is brought about by manually operating the switch (24).

When the outlet mouth (20) is turned towards the wetted scalp of the person using the hair drier, the flow of hot air exiting from the said mouth (20) is enriched with the water contained in the hair and this enables the latter to be dried.

The contemporaneous actuation of the generator (28) resulting from the manual operation of the pushbutton (30) causes the electrode (36) to be polarized and the flow of air passing through the outlet mouth (20) to be ionized.

By carrying the alternatively positive and negative ions produced through the electrode (36) in the direction of the hair, the said flow of air eliminates static electricity therefrom and thus renders the combing and hair setting operations easier.

According to a form of embodiment illustrated in FIG. 2 in which for devices corresponding to those shown in FIG. 1 the same reference numbers have been used, the device in question takes the form of a hood type hair drier (39).

With the case illustrated in FIG. 2, the hood (39) is sustained through a support member (40) by an upright member (41) that rests on a pedestal (42).

In the specific case of the version with hood, the device according to the invention can be provided with a pedal (43) for operating the generator (28) which, in the case illustrated, is housed inside the pedal itself.

Again in this particular case, the generator can be constituted by a piezoelectric transducer although, as already stated, it can be constituted by any other equivalent device.

The hood type apparatus shown in FIG. 2 is provided with a plug (45) at which the lead (26) ends.

The inside of the hood (39) houses the electric fan (46) and the heating elements (22) and it is possible for the latter to be supported by a metal protection screen (49).

Four electrodes (36) are provided in the case illustrated for the hood (39) and these are turned radially with respect to the cross section of the hood (see FIG. 3) and can be fashioned, as shown in FIG. 4, by cutting them out of a piece of sheet metal, leaving a rim (51) to interconnect them.

Through the electrically conductive cable (34), the said electrodes are connected to the generator (28) housed in the control pedal (43).

Furthermore, the hood (39) is provided with a grid (52) so positioned as to cover all the aforementioned devices in such a way as to constitute a guard.

Naturally both in the case of the hair drier (10) and of the hood type hair drier (39), the electrodes (36) can differ in number from what has been shown in the drawings, in order to conform with the individual needs and requirements.

It is obvious, furthermore, that the hair driers (10) and (39) can adopt any different conformation that is suitable and that they can be utilized, as well as hair driers, also as general devices that are able to produce a flow of ionized air for neutralizing electrostatic charges from any object.

What is claimed is:

1. A device for neutralizing electrostatic charges comprising:
   - a ducted electric fan connected to an electric supply circuit;
   - at least one electric generator for alternatively producing electric charges of opposite sign, said at least one electrical generator being constituted by at least one piezo-electric transducer and being connected to an operating pushbutton which can be operated manually or by a petal;
   - at least one metal electrode connected electrically to said at least one piezo-electric transducer and placed along a path followed by flow of air exiting from the device and generated by said electric fan.

2. A device according to claim 1, wherein said operating pushbutton is wired to an electrically conductive member connected to said at least one piezo-electric transducer.

3. A device according to claim 1, wherein said operating pushbutton is made of electrically conductive material.

4. A device according to claim 1, wherein said electric fan is an integral part of a hair dryer having a hand grip, wherein said at least one metal electrode is positioned and supported inside a duct from which flow of air generated by said electric fan exits, downstream with respect to electric means for heating said flow of air, said at least one piezo-electric transducer being positioned inside said hand grip of said hair dryer, and wherein said operating pushbutton is also positioned inside said hand grip of said hair dryer and can be actuated manually from outside said hand grip.

5. A device according to claim 1, wherein said electric fan is an integral part of a hood-type hair dryer having a hood, wherein downstream with respect to said electric fan, means are provided for heating the flow of air generated by said electric fan, wherein downstream with respect to said heating means, said at least one metal electrode is positioned, oriented radially with respect to a cross section of said hood, and wherein said at least one piezo-electric generator is housed inside a pedal-actuated operating device.

* * * * *